United States Patent [19]

Ode

[11] Patent Number: 4,752,192

[45] Date of Patent: Jun. 21, 1988

[54] ROTATING DRUM PUMP HAVING A PLURALITY OF FLUID DRIVEN PISTONS

[75] Inventor: Bengt Ode, Västerås, Sweden

[73] Assignee: AB Asea-Atom, Västerås, Sweden

[21] Appl. No.: 60,819

[22] Filed: Jun. 12, 1987

[30] Foreign Application Priority Data

Jun. 13, 1986 [SE] Sweden ..... 8602651

[51] Int. Cl.[4] ..... F04B 1/00

[52] U.S. Cl. ..... 417/271; 417/338; 417/342

[58] Field of Search ..... 417/225, 271, 338, 339, 417/342; 91/499, 502, 486

[56] References Cited

U.S. PATENT DOCUMENTS

| | | | |
|---|---|---|---|
| 2,579,670 | 12/1951 | Hjärpe | 417/225 |
| 2,592,940 | 4/1952 | Monoyer | 417/225 X |
| 2,847,984 | 8/1958 | Gallant | 91/486 X |
| 2,876,704 | 3/1959 | Collion et al. | 417/271 |
| 3,405,641 | 10/1968 | Coberly | 417/271 |
| 3,516,761 | 6/1970 | Scroggins | 417/342 X |
| 3,999,895 | 12/1976 | Boyle | 417/271 |
| 4,500,261 | 2/1985 | Ode et al. | 417/271 X |

FOREIGN PATENT DOCUMENTS

| | | | |
|---|---|---|---|
| 903900 | 2/1954 | Fed. Rep. of Germany | 91/502 |
| 910526 | 2/1946 | France | 417/339 |

*Primary Examiner*—Carlton R. Croyle
*Assistant Examiner*—Paul F. Neils
*Attorney, Agent, or Firm*—Watson, Cole, Grindle & Watson

[57] ABSTRACT

A rotating drum pump having a plurality of fluid driven pistons includes a pump housing with an enclosed rotating drum, and connection openings for a supplied and discharged driving fluid and for a supplied and discharged pump flow located in end walls of the housing. The drum comprises several cylinder spaces arranged axially in pairs and concentrically arranged inside the envelope surface thereof. In the cylinder spaces, which are arranged axially in pairs and are separated by a partition, there are arranged a drive piston and a pump piston interconnected by a piston rod passing in a sealed manner through the partition. During the rotation of the drum, a driving fluid is supplied to one side of the driving side and urges the drive piston connected to the pump piston, whereby a pump flow is pressed out with the pump piston from one side of the pump side whereas driving fluid from the other side of the driving side is discharged and pump flow is supplied to the cylinder space on the other side of the pump side.

8 Claims, 2 Drawing Sheets

ROTATING DRUM PUMP HAVING A PLURALITY OF FLUID DRIVEN PISTONS

TECHNICAL FIELD

The present invention relates to a pump means for pumping a multi-phase flow consisting of a mixture of gas, liquid and finely-divided solid material with a mutually variable ratio of mixture. The pump means is fluid-driven with a pressurized driving fluid which exerts an influence on drive pistons connected to pump pistons in cylinder spaces in a rotating drum.

BACKGROUND ART

From, for example, U.S. Pat. No. 3,999,895 (Bede Alfred Boyle) a hydraulically driven pump means is previously known, in which several axial cylinder spaces in a rotor are arranged concentrically and comprise drive pistons which are each connected to a pump piston. At one end of the pump means, a driving fluid is supplied and discharged, and at the other end a pump flow is supplied and discharged. Other technical solutions involving several conically arranged cylinder spaces in a rotor in which, in each cylinder space, a drive piston is connected to a pump piston, are also previously known from U.S. Pat. No. 4,500,261 (Ode, Törnblom). When the motor is driven round, the hydraulic pressure influences the drive piston, connected to the pump piston, for pumping of a flow.

DISCLOSURE OF THE INVENTION

Figure 1:
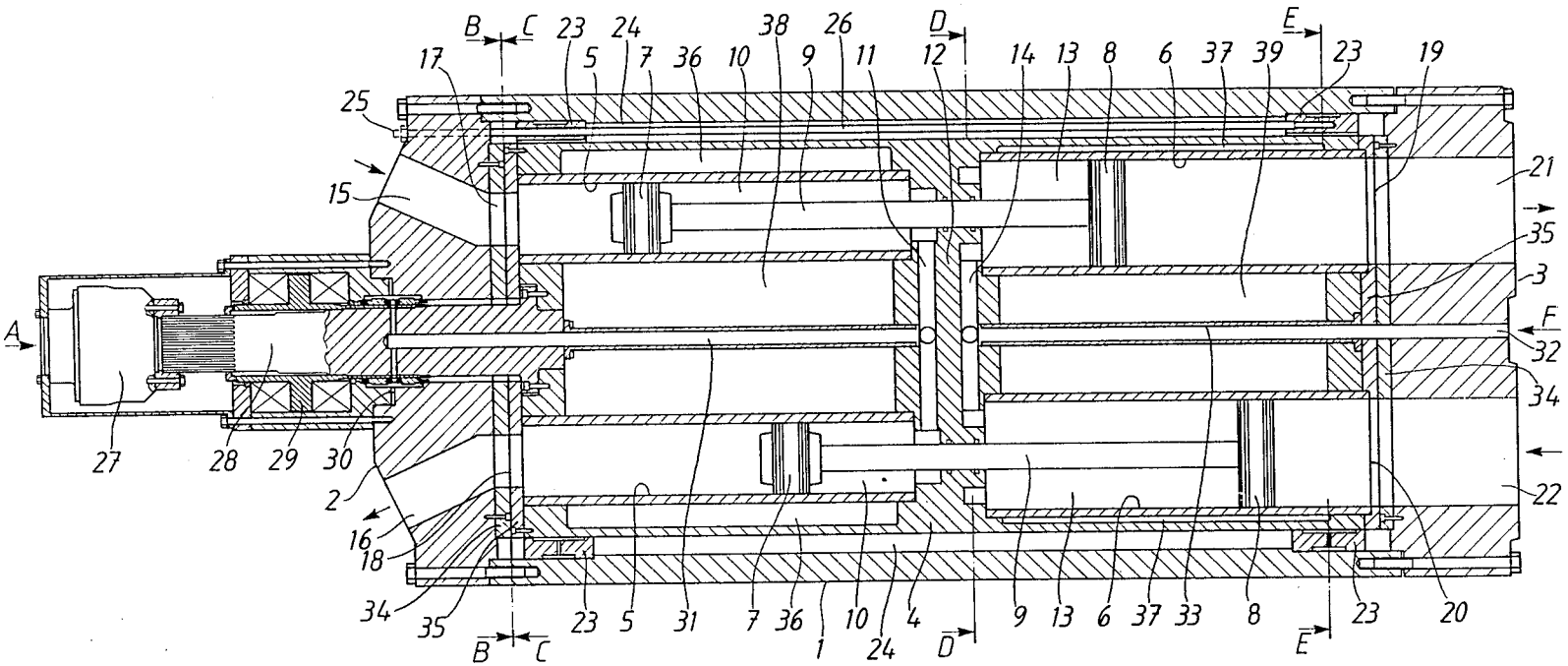
FIG. 1 shows a longitudinal section of a pump means according to the invention.
Figure 2C:
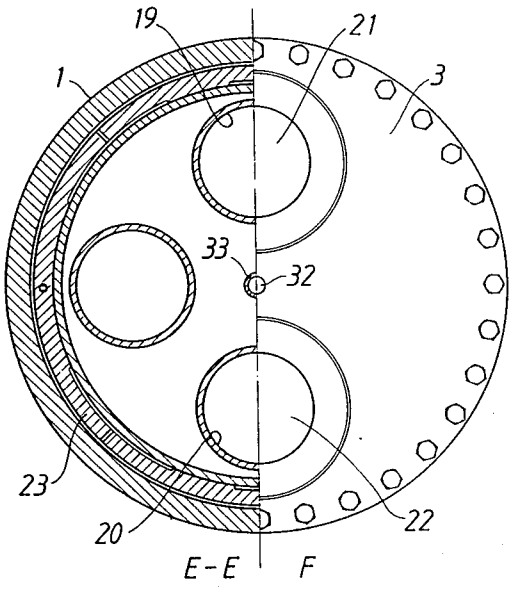
FIGS. 2A, 2B and 2C show cross sections of the pump means.
Figure 2B:
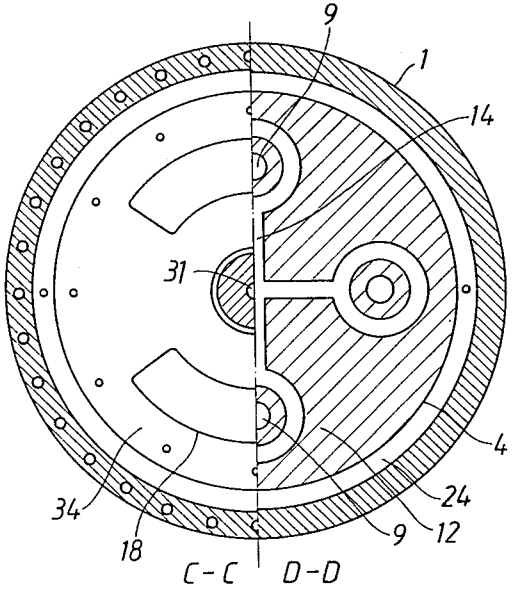
Figure 2A:
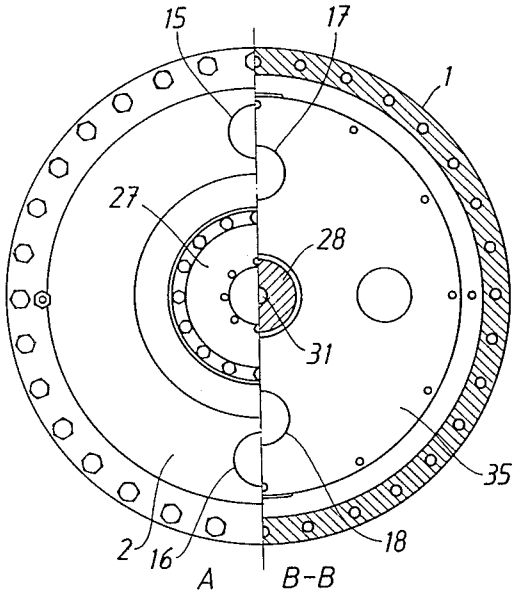

To be able to counteract erosion and cavitation with retained effect when pumping multi-phase flows consisting of a mixture of gas, liquid and finely-divided solid material with a mutually variable ratio of mixture, a new type of pump means is provided which is slowly rotating and has few movable parts. The pump means mainly consists of a closed rotating drum, which is journalled in and surrounded in a sealed manner by a pump housing. The end walls of the housing are provided with gate openings for the supply and discharge of a driving fluid and a pump flow. The drum accomodates a number of cylinders with drive pistons which are each connected to a pump piston.

The pump means may, for example, be used as an underwater pump for pumping a well flow from a drill hole on the bottom of the sea. The underwater pump is then placed on the sea bottom in immediate proximity to the drill hole, and the well flow can be pumped directly to shore for further action. With the sealed surrounding pump housing, the pump will be relatively insensitive to an external corrosive atmosphere. The enclosed movable parts are few and they move at a relatively low speed and are surrounded by a liquid. All this contributes to give a minimum internal wear.

The design and function of the pump means deviate to a considerable extent from prior art pump designs. It is robust, insensitive and flexible, which allows for a wide range of applications.

In connection with the recovery of oil, economic advantages are provided in that the smallest possible amount of equipment need be located on the sea bottom.

By preparing an installation, the pump can be installed only when it is needed, which also gives a favorable investment profile. At the same time, low operating and maintenance costs as well as a high operating availability and a long life can be expected.

Some of the most important advantages derived by the pump means in connection with oil recovery on the sea bottom are the following:

a flexible application

- it is suitable for different types of well flows, also multi-phase flows with varying gas contents
- it is insensitive to uncertainties or changes in well data
- it provides a great operating range both for presssure and for flow for one and the same size of the pump means
- it involves the smallest possible need of equipment on the sea bottom (no electric power equipment, no separation equipment, few instruments), which affects the investment cost as well as the operating availability
- it gives a favourable investment profile; the pump need not be installed until it is needed, i.e. when the reservoir pressure starts to drop
- it has a high efficiency (90%)
- it has a robust design, rotates slowly, has few movable part and is insensitive to sand (abrasion)
- it is suitable for underwater installation and diverless maintenance, it has a totally enclosed design with few connection points
- it permits "pigs" to be transported through the pump.

The pump means is relatively insensitive to uncertainties or changes in well data, for example productivity (pressure, flow), free gas volume (gas/oil ratio), the presence of sand (abrasion), that is to say, the pump can be utilized during the entire lifetime of an oil reservoir without the efficiency and function being deteriorated. Furthermore, the pump is insensitive to a multi-phase flow and different flow states because of a robust design and the low velocities of movable parts. This eliminates the need of separators and/or mixers on the suction side of the pump.

A great flexibility may also prevail regarding the choice of the driving flow to the pistons. In addition to hydraulic fluid, salt water and fresh water, water from, for example, a pressurized aqueous sphere or an untreated well stream with sufficient driving pressure may be used. There will be a potentially greater possibility of withstanding so-called slugs since the structural parts included are robust and work at a low speed, i.e. the dynamic forces are smaller. For a given design and size the pump may have a vary large working range both with regard to pressure and to flow. A centrifugal pump, on the other hand, is very sensitive when deviating from the chosen operating point. The flow can be regulated in a simple manner by varying the speed and the length of stroke, which is made by varying the pressure of the driving flow.

The efficiency lies at about 90%, i.e. considerably higher than for a hydraulically turbine driven centrifugal pump.

The pump means may be completely hydraulically driven, in which case there is no need of electric power supply. All potential error sources from an electric power supply system are eliminated (cables, electric underwater couplings, transformers, electric motors, instrumentation and monitoring). The need of instrumentation for measuring, monitoring and controlling is reduced in comparison with centrifugal pumps. The pump is a type of displacement pump, whereby, in principle, the flow is known when the speed and stroke of the pump are known.

A slow rotation and low relative speeds between the structural parts included reduce the risk of wear. Speeds lower than 100 r.p.m. are here to be compared with centrifugal pumps with speeds amounting to 3,000–8,000 r.p.m. The rotary motion can be brought about by a slowly rotating hydraulic motor with direct drive. The design principle of a hydraulic motor makes it suited for operation in water at large ocean depths.

Furthermore, all movable parts are enclosed within the lubricating hydraulic fluid, which reduces the risk of wear. No structural parts are sensitive to, for example, abrasion (blasting) from solid particles (sand), as is the case when a pump wheel rotates at a high speed.

The pump means may be provided with piston rings and wear rings, which may be replaced in accordance with pre-determined planned intervals and which are prepared for a simple replacement. Great freedom is provided as regards the choice of materials, which is not dependent on the constructive aspects of pump technique. Also "exotic" materials, for example ceramic materials, are therefore a fully feasible alternative. The movements of the pump pistons contribute to "self-cleansing" of the pump cylinders in view of, for example, wax deposits. The design allows "pigs" of a simple design to be transported through the pump. Furthermore, the pump is housed within a totally enclosed cylindrical pump housing, which is capable of withstanding the external overpressures prevailing at great ocean depths and which may have a small number of couplings for the hydraulic connections.

DESCRIPTION OF A PREFERRED EMBODIMENT

The accompanying Figures shown an embodiment of a pump means in accordance with the invention. The pump means consists of a closed and sealed pump housing 1 with end walls 2, 3. The end walls 2, 3 are provided with connection openings for a driving fluid and a pump flow. A drive motor is connected to one end wall 2. The pump housing 1 encloses a rotatable drum 4. The drum 4 contains several axial cylinder spaces 5, 6, which are arranged axially in pairs with a common centre line, parallel to and concentrically inside the periphery of the drum 4. The drum 4 exhibits one driving side and one pump side. In each cylinder space 5 on the driving side there is arranged a drive piston 7 driven by a source of pressurized fluid (not shown) in the normal manner. In each cylinder space 6 on the pump side there is arranged a pump piston 8. The cylinder spaces 5 on the driving side are separated from the cylinder spaces 6 on the pump side by means of a partition 12. In the cylinder spaces 5, 6 which are arranged axially in pairs, each drive piston 7 on the driving side is connected to a pump piston 8 on the pump side by means of a piston rod 9 which passes in a sealed manner through the partition 12. A space 10 behind each drive piston 7 is connected to a first connecting channel 11 through the partition 12. In this wall all the spaces 10 behind the drive pistons 7 are connected to each other. A space 13 behind each pump piston 8 is connected to a second connection channel 14 through the partition 12. In this way all the spaces 13 behind the pump pistons 8 are connected to each other. In the first end wall 2 there are a connection opening 15 for the supplied driving fluid and a connection opening 16 for the spent/discharged driving fluid. In the inner part of the first end wall 2 an upper opening 17 is arranged in communication with the connection opening 15 for conveying driving fluid to a corresponding opening in the rotatable drum 4. A lower opening 18 is arranged in communication with the connection opening 16 for conveying driving fluid from a corresponding opening in the rotatable drum 4. In the upper part of the second end wall 3 an upper opening 19 is arranged for conveying discharged pump flow from a corresponding opening in the rotatable drum 4 to an outer connection opening 21 in the end wall 3. A lower opening 20 is arranged for conveying supplied pump flow to a corresponding opening in the rotatable drum 4 from an external connection opening 22 in the end wall 3. The rotatable drum 4 is journaled at its ends by means of hydrostatic sliding bearings 23 and is otherwise surrounded by a cavity 24, for example filled with a fluid. The pump housing 1 supports the sliding bearings 23 and is separated from the rotatable drum 4 by means of the cavity 24. A driving fluid/lubricant is supplied to the upper part of the first end wall 2 through a connection opening 25 to the hydrostatic sliding bearings 23 on the driving side and via a connecting pipe 26 to the sliding bearings 23 on the pump side. A fluid-driven torque motor 27 is connected to the input shaft 28 of the rotating drum 4, said input shaft 28 being journaled by a thrust bearing 29 in the first end wall 2. Motor 27 is driven by a source of pressurized fluid (not shown) in the normal manner. In connection with the passage of the input shaft 28 through the end wall 2, pressurized driving fluid is supplied through the connection opening 30 via some external pressure supply to a first inner connecting channel 31 connected to the first connecting channels 11. A second inner connecting channel 33 transmits the supply of fluid from a connection opening 32 to the second connecting channels 14. Wear surfaces 34 are provided in the end walls 2, 3, acting against wear surfaces 35 in the end surfaces of the rotating drum 4. The wear surfaces 34, 35 are formed with the openings 17, 18, 19, 20 necessary for the passage of driving fluid and pump flow. An external sealed space 36, 37 is arranged around the drive and pump cylinders 5, 6 and inside the envelope surface of the drum 4. An internal sealed space 38, 39 is arranged inside the drive and pump cylinders 5, 6. The cavity 24 between the pump housing 1 and the drum 4 may be filled with a pressurized fluid to counteract the affect of an external aggressive environment under overpressure.

In operation of the pump means, pressurized driving fluid is supplied to the fluid-operated motor 27 for the rotation of the drum 4 and to the connection openings 15 in the first end wall 2, and further to the upper opening 17. When the drum 4 rotates, the cylinder spaces 5, 6 pass the openings in sequence. When on the driving and pump sides the corresponding opening in the cylinder space 5 during the rotation of the drum 4 opens the connection, the driving fluid is supplied to the cylinder space 5 and presses the drive piston 7 inwards, whereby at the same time the assembled pump piston 8 is moved outwards and presses the received pump flow out through the opening 19 to the connection opening 21. During the inward movement of the drive piston 7, the driving fluid behind the piston, which is supplied through the connection 30, 31, will be transmitted via the first connecting channel 11 under pressure to the space 10 behind the drive piston 7 on the opposite side of the drum 4, which is thereby moved back while at the same time the assembled pump piston 8 is moved inwards. From the connection opening 22 and the opening 20, the pump flow can then be received by the cylinder space 6 on the pump side. Also in this case the spaces 13 behind the pump pistons 8 are interconnected. Through the connection 32, 33, fluid is supplied to the second connecting channel 14. During the return movement of the drive piston 7, the spent driving fluid will be restored through the opening 18 to the connection opening 16 in the end wall 2. Then, during the rotation of the drum 4, pump flow supplied in the lower position will be discharged in the upper position whereas driving fluid is supplied in the upper position and is discharged in the lower position.

I claim:

1. A rotating drum pump having a plurality of fluid driven pistons for pumping a multi-phase flow consisting of a mixture of gas, liquid and finely-divided solid material with a variable mutual ratio of mixture, comprising a driven rotor body with several axially and concentrically arranged cylinder spaces, movable pistons in each cylinder space with one driving side and one pump side, a fixed sealed connection part for supplied and discharged driving fluid on one side of the rotor body, and a fixed sealed connection part for supplied and discharged pump flow on the other side of the rotor body, the improvement wherein the cylinder spaces in the rotor body are concentrically arranged axially in pairs with a common center line and separated by means of a partition, in each axial pair of cylinders there being arranged in pairs one drive piston and one pump piston interconnected by a piston rod passing in a sealed manner through the partition, and a space behind each drive piston being connected to a channel in the partition and being filled with a driving fluid for transmission of said fluid from the rear side of a driven drive piston to the rear side of a nondriven drive piston.

2. The pump according to claim 1, wherein the rotor body has opposing end walls the insides of which are provided with fixed wear surfaces having openings for the passage of a fluid, said wear surfaces acting against wear surfaces fixed to opposing end surfaces of the rotor body, with openings for the passage of a fluid.

3. The pump according to claim 1, wherein a connection opening is provided for the supply of a pressurized driving fluid via a connecting channel to the connecting channels in the partition.

4. The pump according to claim 1, wherein the rotor body comprises a drum surrounded by a sealed, surrounded envelope surface of a pump housing and with end walls with connection openings for a driving fluid and a pump flow.

5. The pump according to claim 4, wherein the drum is connected, by means of a shaft passing through one of said end walls of the pump housing, to a fluid-driven motor.

6. The pump according to claim 4, wherein at the end walls of the pump housing the drum is journaled in hydrostatic sliding bearings a liquid being adapted to be supplied to the bearings through a connection opening in one of said end walls and further with a connecting pipe.

7. A rotating drum pump having a plurality of fluid driven pistons for pumping a multi-phase flow consisting of a mixture of gas, liquid and finely-divided solid material with a variable mutual ratio of mixture, comprising a driven rotor body with several axially and concentrically arranged cylinder spaces, movable pistons in each cylinder space with one driving side and one pump side, a fixed sealed connection part for supplied and discharged driving fluid on one side of the rotor body, and a fixed sealed connection part for supplied and discharged pump flow on the other side of the rotor body, the improvement wherein the cylinder spaces in the rotor body are concentrically arranged axially in pairs with a common center line and separated by means of a partition, in each axial pair of cylinders there being arranged in pairs one drive piston and one pump piston interconnected by a piston rod passing in a sealed manner through the partition, a space behind each said pump piston being connected to a channel in the partition and being filled with a fluid for transmission of said fluid from the rear side of an ingoing pump piston to the rear side of an outgoing pump piston.

8. The pump according to claim 7, wherein a connecting channel is adapted to connect a connection opening in an end wall with the connecting channels in the partition.

* * * * *